US005876862A

United States Patent [19]

Shibuya et al.

[11] Patent Number: 5,876,862

[45] Date of Patent: Mar. 2, 1999

[54] SLIDING CONTACT MATERIAL, CLAD COMPOOSITE MATERIAL, COMMUTATOR EMPLOYING SAID MATERIAL AND DIRECT CURRENT MOTOR EMPLOYING SAID COMMUTATOR

[75] Inventors: Isao Shibuya, Motono-mura; Toshiya Yamamoto, Hiratsuka; Takao Asada, Hiratsuka; Tetsuya Nakamura, Hiratsuka, all of Japan

[73] Assignees: Mabuchi Motor Co., Ltd.; Tanaka Kikinzoku Kogyo K.K., both of Japan

[21] Appl. No.: 732,323

[22] PCT Filed: Feb. 23, 1996

[86] PCT No.: PCT/JP96/00409

§ 371 Date: May 6, 1997

§ 102(e) Date: May 6, 1997

[87] PCT Pub. No.: WO96/26526

PCT Pub. Date: Aug. 29, 1996

[30] Foreign Application Priority Data

Feb. 24, 1995 [JP] Japan ..... 7-61823
Feb. 26, 1996 [JP] Japan ..... 8-32786

[51] Int. Cl.[6] ..... H01H 1/02; H01R 39/04; C22C 5/02; C22C 5/08

[52] U.S. Cl. ..... 428/672; 428/673; 428/674; 428/929; 200/266; 200/267; 200/668; 420/503; 420/508; 420/510; 420/511

[58] Field of Search ..... 420/502, 503, 420/511, 508; 200/266, 267, 268, 269; 428/673, 672, 929, 614, 674

[56] References Cited

U.S. PATENT DOCUMENTS

| | | | |
|---|---|---|---|
| 3,411,900 | 11/1968 | Roeder et al. | 420/503 |
| 3,591,370 | 7/1971 | Denereaz | 420/502 |
| 3,617,785 | 11/1971 | Kristiansen | 310/236 |
| 3,648,355 | 3/1972 | Shida et al. | 29/471.7 |
| 4,255,191 | 3/1981 | Kropp | 420/503 |
| 4,314,848 | 2/1982 | Todoroki et al. | 420/502 |
| 4,522,783 | 6/1985 | Menicucci | 420/503 |
| 4,971,759 | 11/1990 | Watanabe et al. | 420/502 |
| 5,484,569 | 1/1996 | Klein et al. | 420/503 |

FOREIGN PATENT DOCUMENTS

| | | | |
|---|---|---|---|
| 0057149 | 8/1982 | European Pat. Off. | 420/503 |
| 52-23659 | 2/1977 | Japan | 420/502 |
| 59-14210 | 1/1984 | Japan | 420/502 |
| 60-121625 | 6/1985 | Japan | 200/266 |
| 541439 | 11/1941 | United Kingdom | 420/503 |

OTHER PUBLICATIONS

Harmsen, Nils, "Spring–Hard Precikous Metal Alloys . . . for Electrical Contract", IEEE Transactions on Components, vol. CHMT–1, No. 1, pp. 79–83, Mar. 1978.

Sterner–Rainer, "Einige Eigenschaften der Legierungen Au–Ag–Cu", May 1926.

*Primary Examiner*—John J. Zimmerman
*Attorney, Agent, or Firm*—Klauber & Jackson

[57] ABSTRACT

Sliding contacts comprising alloys such as Pd/Cu/Ag, Pt/Cu/Ag, Pd/Cu/Ag/Ni, Pt/Cu/Ag/Ni, Ag/Pd/Cu,Au, Ag/Pt/Cu/Au and two-layered composites comprising a surface layer of one of the foregoing alloys and a base layer comprised of copper or a copper-containing alloy. Also, three-layered composites comprising a surface layer of one of the foregoing alloys, an intermediate layer of one of the foregoing alloys and a base layer comprised of copper or a copper-containing alloy as well as direct current motors comprising commutators comprising a three-layered composite.

17 Claims, 1 Drawing Sheet

SLIDING CONTACT MATERIAL, CLAD COMPOOSITE MATERIAL, COMMUTATOR EMPLOYING SAID MATERIAL AND DIRECT CURRENT MOTOR EMPLOYING SAID COMMUTATOR

CROSS REFERENCE TO RELATED APPLICATIONS

This application is an application which has been filed under 35 U.S.C. §371 from parent International Application No. PCT/JP96/00409 having an international filing date of 23 Feb. 1996.

BACKGROUND OF THE INVENTION

The present invention relates to contact material employed for an electrically and mechanically sliding portion, and more specifically to the contact material and clad composition material containing the contact material which may be employed in a commutator equipped in a direct current motor, especially in a direct current compact motor, having a sufficiently long life and a low starting voltage when it is employed for the material of a compact disk spindle.

In recent years, the number of apparatuses in which sliding contact occurs has been increased in the field of electronic industries so that the development of new sliding contact material and the research regarding abrasion have been extensively conducted. The abrasion and the contact resistance are problematic in the sliding contact material, but this abrasion phenomenon is complex so that there are many aspects academically unelucidated.

Even though the metal surface of the contact material is intended to be finished relatively smoothly, the microscopic observation reveals that the surface is not a completely flat surface but ordinarily possesses minute unevenness. Although two metal surfaces appear to be in contact with each other with a large contact area, they are actually in contact with each other only with isolated projections due to the existence of the several concaves and convexes.

The abrasion due to the friction is basically proportional to the strength of a contact force and inversely proportional to the hardness. A temperature, a humidity, a corrosive component, organic vapor, dust and the like are factors introducing a change in the abrasion and electrical performances (contact resistance).

The wear in the sliding contact material is largely divided into adhesive wear and abrasion wear. The adhesive wear takes place by means of the welding between the metals of the actual contact potions or the projections so as to tear off the softer metal which is shifted to the harder metal.

The abrasion wear is induced when two groups of material having largely different hardnesses are rubbed with each other or when two groups of soft material one of which contains hard particles are rubbed.

The sliding contact material is widely utilized for an earth ring, a rotary switch and other devices inclusion a direct current compact motor for a compact disk spindle and a commutator employed in the direct current compact motor. Three-layered clad composite material employed as a conventional commutator for a compact disk spindle of a direct current compact motor is known to consist of a surface layer composed of an Au—Ag alloy consisting of 40% in weight of Ag and a balance of Au, an intermediate layer composed of an Ag—Cu—Ni alloy consisting of 4% in weight of Cu. 0.5% in weight of Ni and a balance of Ag and a base layer composed of a Cu—Sn—Ni alloy consisting of 9.5% in weight of Ni, 2.5% in weight of Sn and a balance of Cu.

Another pertinent prior reference discloses a rectifier having as a commutator an Ag—Pd—Cu alloy essentially consisting of 2 to 10% in weight of Cu, 2 to 10% weight of Pd and a balance of Ag. However, in this rectifier, the improvements on the performances, especially under a high temperature circumstance, such as the increase of a contact resistance and instabilities generated by black powder produced due to Pd and the generation of an electrical noise have been requested.

With the miniaturization of audio devices in the recent years, the direct current compact motor is equipped near a heating element such as an amplifier so that the temperature of the motor even at normal operation condition may reach to 70° C. Especially when the motor is equipped in an automobile, the temperature under the midsummer burning sun may reach over 70° C.

Generally, the life of the direct current compact motor equipped with a brush under the high temperature circumstance is unexpectedly short. While the above motor has a life of about 6000 hours under a circumstance of a temperature of 25° C. and a humidity of 60%, its life may be reduced to about 200 hours under a circumstance of a temperature of 70° C. and a humidity of 5%.

Accordingly, the development of a direct current compact motor which does not lose the durability under the high temperature has been demanded.

As a result of detailed investigation of the reasons why the life is reduced, it has been clarified that the commutator material is scraped off by means of a brush at the time of sliding between the commutator and the brush under a high temperature circumstance, which is deposited on the brush surface to form projection-like sediment, and the projection acts as if it were a blade to scrape off the commutator material long and narrow.

The long and narrow needle-like powder thus produced fills the spaces among the divided cylindrical commutator to short-circuit and electrically conduct the divided commutators so as to result in the stopping of the motor.

Even if the electrical conduction does not occur, the abrasion rate under the above high temperature condition is larger than that of the condition of a temperature of 25° C. and a humidity of 60%, and the scraping-off of almost all the motors reaches to the Cu alloy of the base layer in 500 hours not only to increase the contact resistance but also to hinder the conduction by means of CuO derived from the exposed Cu so that the motor functionally stops.

SUMMARY OF THE INVENTION

An object of the present invention is to provide sliding contact material which possesses durability over a relatively long period of time.

Another object of the present invention is to provide clad composite material containing the said sliding contact material.

A further object of the present invention is to provide a commutator containing the clad composite material.

A still further object of the present invention is to provide a direct current motor containing the said commutator having a life over 2000 hours over a wide temperature range between 30° and 70° C.

A still further object of the present invention is to provide a direct current compact motor employed for a compact disk spindle.

The present invention may provide the below eight alloys employed for sliding contact material of an electrically and mechanically sliding portion of a sliding contact (all numerals are % in weight).

① Ag(10 to 60)-Cu(0.1 to 7)-Au (balance)

② Ag(10 to 60)-Pd(0.1 to 7)-Cu (0.1 to 7)-Au (balance

③ Ag(10 to 60)-Pt(0.1 to 7)-Cu (0.1 to 7)-Au (balance

④ Cu(5 to 10)-Ni (0.1 to 1)-Ag (balance)

⑤ Pd(0.1 to 1.5)-Cu (3 to 10)-Ag (balance)

⑥ Pd(0.1 to 1.5)-Cu (3 to 10)-Ni (0.1 to 1)-Ag (balance)

⑦ Pt(0.1 to 1.5)-Cu (3 to 10)-Ag (balance)

⑧ Pt(0.1 to 1.5)-Cu (3 to 10)-Ni (0.1 to 1)-Ag (balance)

The present invention also provides two-layered clad composite material which comprises a surface layer composed of the above sliding contact material ① to ⑧ and a base layer composed of Cu or a Cu alloy.

The present invention also provides three-layered clad composite material which comprises a surface layer composed of the above sliding contact material ① to ⑧, an intermediate layer composed of the above sliding contact material ① to ⑧ and a base layer composed of Cu or a Cu alloy.

The present invention also provides a commutator which comprises the above clad composition material having the above sliding contact material ① to ⑧.

The present invention also provides a direct current motor which comprises the above commutator.

The above Cu alloy employed as a base layer includes phosphor bronze (CuSnNi alloy). German silver (CuZnNi alloy) and other conventional alloys.

In accordance with the present invention, the deposition of the scraped material to the brush and the resulting generation of the needle-like abrasion power are depressed maintaining the conventional low starting voltage by adding Cu or, Pd or Pt to the AuAg alloy of the surface layer of the three-layered clad composite material.

The deposition of the scraped material to the brush and the resulting generation of the needle-like abrasion powder are also depressed by increasing the amount of Cu in the AgCu alloy or the AgCuNi alloy of the intermediate layer of the three-layered clad material or of the surface layer of the two-layered clad composite material or by maintaining the Cu amount and adding Pd or Pt.

The addition of Pd or Pt in the present invention may be replaced with that of another platinum group element (Ru, Rh, Os, Ir) which produces the same effect.

DETAILED DESCRIPTION OF THE INVENTION

Figure 1:
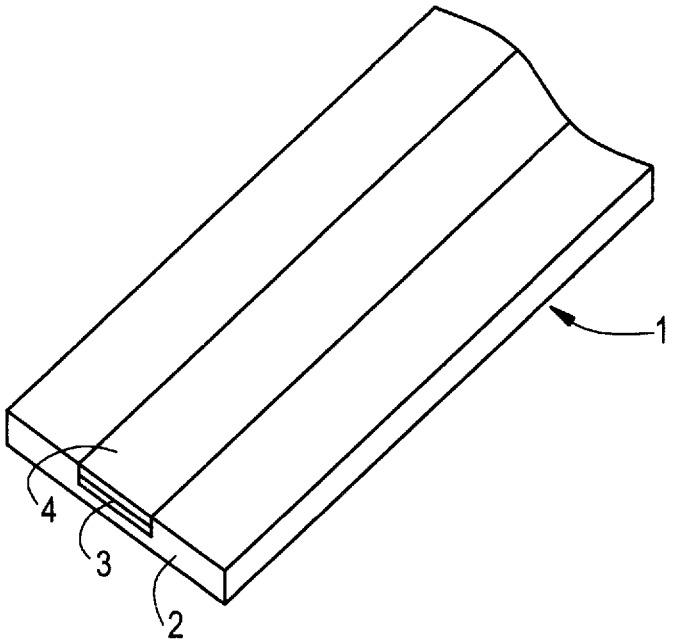
FIG. 1 is a schematic perspective view showing an example of three-layered clad composite mineral in accordance with the present invention.

The sliding contact material and the clad composite material in accordance with the present invention show excellent performances against the deposition thereby removing the deposition from the commutator to the brush to depress the generation of the needle-like abrasion powder while maintaining the excellent contact stability of the AuAg alloy. Naturally, the abrasion rate is decreased and the welding resistance is elevated.

This brings epoch-making results that the starting voltage of the motor can be maintained at a low level and even the extremely thin surface layer of the AuAg based alloy formed for minimizing the change with time possesses an abrasion resistance. Moreover, the increase of the starting voltage of the motor by the addition of Cu or the addition of Pd or Pt is within the permissible range.

The deposition from the alloy to the brush can be removed to depress the generation of the needle-like abrasion powder by increasing the amount of Cu in the AgCu alloy or the AgCuNi alloy mainly taking charge of the elevation of the abrasion resistance or adding Pd or Pt.

Naturally, the abrasion rate is decreased and a remarkably longer life compared with that of conventional material can be realized.

The increase of the starting voltage of the motor by means of the increase of the Cu amount or the addition of Pd or Pt is within the permissible range.

The reasons why the compositions are restricted in claims 1 to 8 are as follows.

AuAgCu Alloy

The AuAgCu alloy is one in which its abrasion resistance is elevated while maintain its contact resistance and anti-sulfur performance by means of adding a small amount of Cu to a conventional AuAg alloy.

Accordingly, if the Ag content is below 10% in weight, the hardness is so low that the adhesive wear is likely to occur. On the other hand, if the Ag content is over 60% in weight, especially the anti-sulfur performance becomes inferior to deteriorate the performances with time. If the Cu content is below 0.1% in weight, no effects of elevating the abrasion resistance are produced, and if it is over 7% in weight, the contact resistance becomes larger to elevate the starting voltage when it is incorporated in a motor.

It is most effective that the Ag content is adjusted to be 30 to 50% in weight, the addition of Cu is adjusted to be 3 to 6% in weight and the balance is Au.

AuAgPdCu Alloy

The AuAgPdCu alloy is one in which its abrasion resistance is further elevated while maintaining its contact resistance and anti-sulfur performance by means of adding a small amount of Pd to the AuAgCu alloy.

Accordingly, the addition effects of Ag and Cu are the same as those of the AuAgCu alloy, and if the Pd content is below 0.1% in weight, no effects of adding Pd to the AuAgCu alloy are produced, and if it is over 7% in weight, the black powder is easily produced to make its contact resistance unstable.

It is most effective that the Ag content is adjusted to be 30 to 50% in weight, the addition of Cu is adjusted to be 3 to 6% in weight, the addition of Pd is adjusted to be 0.5 to 3% in weight and the balance is Au.

PtAuAgCu Alloy

The PtAuAgCu alloy is one in which its abrasion resistance is further elevated while maintaining its contact resistance and anti-sulfur performance by means of adding a small amount of Pt to the AuAgCu alloy.

Accordingly, the addition effects of Ag and CU are the same as those of the AuAgCu alloy, and if the Pt content is below 0.1% in weight, no effects of adding Pt to the AuAgCu alloy are produced, and if it is over 7% in weight, the black powder is easily produced to make its contact resistance unstable.

It is most effective that the Ag content is adjusted to be 30 to 50% in weight, the addition of Cu is adjusted to be 3 to 6% in weight, the addition of Pt is adjusted to be 0.5 to 3% in weight and the balance is Au.

AgCuNi Alloy

The AgCuNi alloy is one in which its abrasion resistance is elevated by means of adding a larger amount of Cu compared with that of the conventional AgCuNi alloy.

Accordingly, if the Cu content is below 5% in width, the Cu content is insufficient and adhesive wear is likely to occur as the conventional alloy, and if Cu content is over 10% in weight, the contact resistance becomes larger to elevate the starting voltage. If the Ni content is below 0.1% in weight, the mechanical performances, especially the elevation of hardness cannot be obtained, and if it is over 1% in weight, the instability of the contact resistance due to oxidation of Ni and the problem regarding its processability remain.

It is most effective that the Cu content is adjusted to be 8 to 10% in weight, the Ni content is adjusted to 0.3 to 0.5% in weight and the balance is Ag.

AgPdCu Alloy and AgPdCuNi Alloy

The AgPdCu alloy and the AgPdCuNi alloy are alloys in which the respective abrasion resistances are elevated while maintaining their contact resistances and anti-sulfur performances by means of adding small amounts of Pd to the conventional AgCu alloy and AgCuNi alloy.

Accordingly, if the Pd addition is below 0.1% in weight, no effects of adding Pd to the AuCu alloy and the AgCuNi alloy are produced, and if it is over 1.5% in weight, the black powder is easily produced to make its contact resistance unstable.

If the Cu content is below 3% in weight, addition effects are seldom produced and the adhesive wear is likely to occur, and if it is over 10% in weight, the contact resistance becomes larger to elevate the starting voltage.

If the Ni content in the AgPdCuNi alloy is below 0.1% in weight, the mechanical performances, especially the elevation of hardness can be scarcely obtained, and if it is over 1% in weight, the instability of the contact resistance due to oxidation of Ni and the problem regarding its processability renain.

It is most effective that the Pd addition is adjusted to be 0.3 to 1% in weight, the Cu content is adjusted to be 3 to 5% in weight and the balance is Ag in the AgPdCu alloy, and that the Pd addition is adjusted to be 0.3 to 1% in weight, the Cu content is adjusted to be 3 to 5% in weight, the Ni content is adjusted to be 0.3 to 0.5% in weight and the balance is Ag in the AgPdCuNi alloy.

PtAgCu Alloy and PtAgCuNi Alloy

The PtAgCu alloy and the PtAgCuNi alloy are alloys in which the respective abrasion resistances are elevated while maintaining their contact resistances and anti-sulfur performances by means of adding small amounts of Pt to the conventional AgCu alloy and AgCuNi alloy.

Accordingly, if the Pt addition is below 0.1% in weight, no effects of adding Pt to the AuCu alloy and the AgCuNi alloy are produced, and if it is over 1.5% in weight, the black powder is easily produced to make its contact resistance unstable.

If the Cu content is below 3% in weight, no addition effects are produced and the adhesive wear is likely to occur, and if it is over 10% in weight, the contact resistance becomes larger to elevate the starting voltage.

If the Ni content in the PtAgCuNi alloy is below 0.1% in weight, the mechanical performances, especially the elevation of hardness can be scarcely obtained, and if it is over 1% in weight, the instability of the contact resistance due to oxidation of Ni and the problem regarding its processability remain.

It is most effective that the Pt addition is adjusted to be 0.3 to 1% in weight, the Cu content is adjusted to be 3 to 5% in weight and the balance is Ag in the PtAgCu alloy, and that the Pt addition is adjusted to be 0.3 to 1% in weight, the Cu content is adjusted to be 3 to 5% in weight, the Ni content is adjusted to be 0.3 to 0.5% in weight and the balance is Ag in the PtAgCuNi alloy.

The same effects of those of adding Pd or Pt can be obtained by the addition of one or more other platinum group elements (Ru, Rh, Os, Ir).

In the AuAgCu alloy claimed in claim 1, the said alloy includes a solid solution alloy as well as an AuAgCu alloy which is prepared in accordance with the description disclosed in Japanese patent laid open gazette No. 6-260255 by diffusing Ag and Cu into Au (diffused material of Ag and Cu to Au) which produces the same effect.

Also in the AuAgPdCu alloy claimed in claim 2 and the PtAuAgCu alloy claimed in claim 3, the same effects produced by the solid solution alloy can be obtained in the diffused material.

The present invention may be effectively applicable to all the sliding contacts including those for a slip ring and a connector as well as for the commutator for the direct current compact motor.

Several examples of the clad composite materials are shown in attached drawings. FIG. 1 is a perspective view showing an example of tape-like three-layered clad composite material in which the clad composite material 1 is composed of a base layer 2 having a concave section and, an intermediate layer 3 and a surface layer 4 located in the concave groove.

Figure 2:
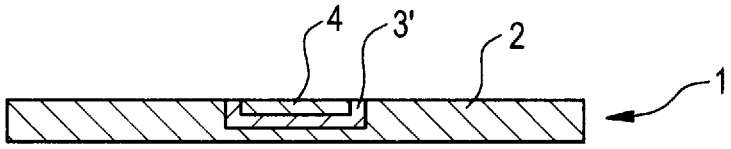
FIG. 2 is a schematic sectional view showing another example of three-layered clad composite material.

FIG. 2 is a sectional view showing an alternative example of the clad composite material of FIG. 1. In FIG. 2, an intermediate layer 3' has a concave section and the both ends of which are exposed.

Figure 3:
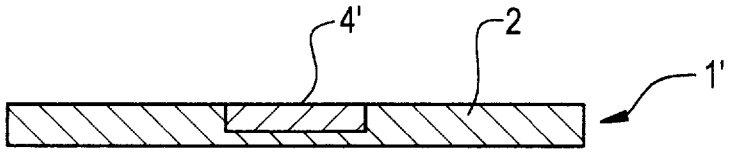
FIG. 3 is a schematic sectional view showing an example of two-layered clad composite material in accordance with the present invention.

FIG. 3 is a schematic sectional view showing an example of two-layered clad composite material. In FIG. 3, clad composite material 1' is composed of a base layer 2 having a concave section and a surface layer 4'.

EXAMPLES

Although Examples of the present invention will be illustrated, these are not construed to restrict the invention. In these Examples, "%" of elements is % in weight unless indicated to the contrary.

Example 1

Tape-like clad material was obtained by joining an Au—Ag(35%)-Cu(5%) alloy to be employed as a surface layer to the surface of an Ag—Pd(1%)-Cu(4)-Ni(0.5%) tape-like alloy to be employed as an intermediate layer. This joined material was inlay-joined to a Cu—Sn(2.3%)-Ni (9.5%) alloy to be employed as a base layer to obtain clad composite material. Tis clad composite material was thermally treated at 750° C. and rolled three times to obtain three-layered clad composite material having a total thickness of 0.3 mm and a width of 19 mm composed of the surface layer having a thickness of 5 μm, the intermediate layer having a thickness of 20 μm and a base layer.

This clad composite material was processed to a triple-pole commutator having an outer diameter of 3.3 mm and a length of 2.4 mm which was then incorporated in a direct current compact motor for a compact disk spindle.

Test conditions were as follows:

Test Temperature:70° C.

Humidity:5% RH

Test Time:96 hours

Load:Actual compact disk

Rotation Mode:One starting and one stop were included per one hour

Rotation Speed:500 rpm

Brush Material:Ag—Pd(50%)

Contact Load:2 gf

Number of Test Motors:10

Upon the completion of the test, the number of the motors the operation of which were made impossible due to the conduction between the commutators produced by needle-like abrasion powder or the like was investigated, the starting voltages of the motors which at the time of the investigation could rotate were measured and the difference between the voltages before and after the test was recorded as a starting voltage difference. After the motors were dismantled, amounts of abrasion powder and black powder deposited on the commutator and the brush were examined and the number of needle-like abrasion powder was counted. Then, an abrasion area of the commutator and its abrasion depth were measured. These results were show in Table 1. Surface hardness of the commutator was recorded for reference.

The evaluation standard is as follows. This standard is unified in all the tests.

| | ⊚ | ○ | Δ | X |
|---|---|---|---|---|
| Abrasion Powder, Black Powder | extremely small | small | medium | large |
| Abrasion Area ($\mu m^2$) | 0 ~ 1000 | ~1500 | ~3500 | 3500~ |
| Abrasion Depth (μm) | 0 ~ 10 | ~15 | ~25 | 25~ |
| Needle-like Abrasion Powder | extremely small | small | medium | large |
| Contact Resistance (mΩ) | 0 ~ 50 | ~150 | ~350 | 350~ |
| Starting Voltage Change (V) | 0 ~ 0.1 | ~0.2 | ~0.5 | 0.5~ |

"Alloy composition/alloy composition" and "alloy composition/alloy composition/alloy composition" in Tables 1 to 5 means the respective alloy compositions of two-layered clad composite material and three-layered clad composite material, respectively, and marks "/" therein mean an interface between the surface layer and the base layer in the two-layered material and those between the surface layer and the intermediate layer and between the intermediate layer and the base layer in the three-layered material.

Example 2

Three-layered clad material consisting of a surface layer composed of an Au—Ag(37%)-Cu(3%) alloy (having a thickness of 5 μm), an intermediate layer composed of an Ag—Pd(1.5%)-Cu(4%)-Ni(0.5%) alloy (having a thickness of 20 μm) and a base layer composed of a Cu—Sn(2.3%)-Ni(9.5%) alloy was obtained in accordance with the procedures of Example 1, which was then incorporated in a motor. The test conditions were the same as those of Example 1, and the results are shown in Table 1.

Example 3

Tape-like clad material was obtained by joining Au to be employed as a surface layer to the surface of an Ag—Cu (10%)-Ni(0.5%) tape-like alloy to be employed as an intermediate layer. This material was thermally treated for diffusing the surface layer to alloy the surface layer which was then inlay-joined to a Cu—Sn(2.3%)-Ni(9.5%) alloy to be employed as a base layer to obtain clad composite material.

This clad composite material was thermally treated at 750° C. and rolled three times to obtain three-layered clad composite material having a total thickness of 0.3 mm and a width of 19 mm composed of the surface layer having a thickness of 5 μm, the intermediate layer having a thickness of 20 μm and as base layer. The AuAgCu alloy of the surface layer (Au diffused material) at this time was analyzed by means of elementary quantitative analysis with EPMA to contain 38.2% of Ag, 6.1% of Cu and a balance of Au.

The incorporation to the motor and the test conditions were the same as those of Example 1 and the results are shown in Table 1.

Example 4

Clad material was obtained by inlay-joining a Cu—Sn (2.3%-Ni(9.5%) alloy to be employed as a surface layer to an Ag—Cn(6%)-Ni(0.5%) alloy to be employed as a base layer.

This clad material was thermally treated at 750° C. and rolled three times to obtain two-layered clad composite material having a total thickness of 0.3 mm and a width of 19 mm composed of the surface layer having a thickness of 20 μm and the base layer.

The incorporation to the motor and the test conditions were the same as those of Example 1 and the results are shown in Table 1.

Examples 5 to 9

In accordance with the procedures of Example 4, five two-layered clad composite materials were obtained which had the respective surface layers composed of an Ag—Cu (8%)-Ni(0.5%) alloy (Example 5), an Ag—Cu(10%)-Ni (0.5%) alloy (Example 6), an Ag—Pd(0.5%)-Cu(4%)-Ni (0.5%) alloy (Example 7), an Ag—Pd(1%)-Cu(4%)-Ni (0.5%) alloy (Example 8) and an Ag—Pd(1.5%)-Cu(4%)-Ni(0.5) alloy (Example 9) and the respective base layers all composed of a Cu—Sn(2.3%)-Ni(9.5%) alloy.

The incorporation to the motor and the test conditions were the same as those of Example 1 and the results are shown in Table 1.

Prior Example 1

Three-layered clad material consisting of a surface layer composed of an Au—Ag(40%) alloy (having a thickness of 2 μm), an intermediate layer composed of an Ag—Cu(4%)-Ni(0.5%) alloy (having a thickness of 20 μm) and a base layer composed of a Cu—Sn(2.3%)-Ni(9.5%) alloy was obtained in accordance with the procedures of Example 1.

The incorporation to the motor and the test conditions were the same as those of Example 1 and the results are shown in Table 2.

Comparative Example 1

Two-layered clad material consisting of a surface layer composed of an Ag—Cu(4%)-Ni(0.5%) alloy (having a thickness of 20 μm) and a base layer composed of a Cu—Sn(2.3%)-Ni(9.5%) alloy was obtained in accordance with the procedures of Example 4.

The incorporation to the motor and the test conditions were the same as those of Example 1 and the results are shown in Table 2.

Comparative Example 2

Two-layered clad material consisting of a surface layer composed of an Ag—Pd(3%)-Cu(4%)-Ni(0.5%) alloy (having a thickness of 20 μm) and a base layer composed of a Cu—Sn(2.3%)-Ni(9.5%) alloy was obtained in accordance with the procedures of Example 4.

The incorporation to the motor and the test conditions were the same as those of Example 1 and the results are shown in Table 2.

Examples 10 and 11 and Prior Example 2

Employing the same test conditions of Example 1 except that the test time was made to be 500 hours, three clad composite materials having the same materials as those of Example 3 (Example 10), of Example 1 (Example 11) and of Prior Example 1 (Prior Example 2) were obtained and processed to commutator which were then incorporated in a direct current compact motor for the above test.

The evaluation standard was conducted in accordance with that of Example 1 though the test time was different and the results are shown in Table 3.

Examples 12 and 13 and Prior Example 3

Employing the same test conditions of Example 1 except that the test temperature was −30° C. and the test was made to be 500 hours, three clad composite materials having the same materials as those of Example 3 (Example 12), of Example 1 (Example 13) and of Prior Example 1 (Prior Example 3) were obtained and processed to commutator which were then incorporated in a direct current compact motor for the above test.

The evaluation standard was conducted in accordance with that of Example 1 though the test time was different and the results are shown in Table 4.

Examples 14 to 18 and
Comparative Examples 4 and 5

In accordance with the procedures of Example 1, seven three-layered clad composite materials were obtained which had the respective surface layers composed of an Au—Ag (37%)-Pd(0.5%)-Cu(3%) alloy (Example 14), an Au—Ag (37%)-Pd(5%)-Cu(3%) alloy (Example 15), an Au—Ag (35%)-Pd(0.5%)-Cu(5%) alloy (Example 16), an Au—Ag (35%)-Pd(5%)-Cu(5%) alloy (Example 17), a Pt(5%)-Au—Ag(35%)-Cu(5%) alloy (Example 18), an Au—Ag(35%)-Cu(5%) alloy (Comparative Example 4) and an Au—Ag (40%)-Pd(5%) alloy (Comparative Example 5) and the respective intermediate layers all composed of a Ag—Pd (0.5%)-Cu(4%)-Ni(9.5%) alloy and the respective base layers all composed of a Cu—Sn(2.3%)-Ni(9.5%) alloy.

Since the performances of these materials were elevated, the test time was changed from 96 hours to 192 hours twice of the original time. The incorporation in the motor and the test conditions were the same as those of Example 1 except for the above test time and the results are shown in Table 5.

Example 19

In accordance with the procedures of Example 4, two-layered clad composite material was obtained which had a surface layer composed of a Pt(0.5%)-Ag—Cu(4%)-Ni (0.5%) alloy and a base layer composed of a Cu—Sn(2.3%)-Ni(9.5%) alloy. This was tested in accordance with the same procedures as those of Example 14, and the results are shown in Table 5.

As apparent from Tables 1 and 2, the abrasion performances including the abrasion powder and black powder, the abrasion area, the abrasion depth and the needle-like abrasion powder at the temperature of 70° C. and the test time of 96 hours in Prior Example 1 were inferior. The needle-like abrasion powder was generated in four motors out of 10 motors in Comparative Example 1 and in 10 motors out of 10 motors in Comparative Example 2 to fill the spaces between the commutators to conduct and short-circuit the said commutators to stop the motors during the test. Especially, it is apparent from Comparative Example 2 that the black powder increased above the Pd content of 1.5% to produce the increase of the contact resistance and the starting voltage.

In Examples 1 to 9, the contact resistances and the starting voltages were low and the abrasion areas and the abrasion depths exhibited remarkably excellent results.

As apparent from Table 3 in which the evaluation was conducted at a temperature of 70° C. and a test hours of 500 hours, the excellent sliding performances were obtained in Example 10 and 11 in which no motors stopped within 500 hours while all motors stopped within 500 hours in Comparative Example 2.

As apparent from Table 4 in which the evaluation was conducted at a temperature of −30° C. and a test hours of 500 hours, the excellent sliding performances were obtained in Example 12 and 13 in which no motors stopped within 500 hours while three motors out of 10 motors stopped in Comparative Example 3.

Further, it is elucidated, as apparent from Table 5, that the improvements in Examples 14 to 19 were more outstanding than those of Comparative Example 4. However, in Comparative Example 5 in which no Cu was contained in the surface layer of the three-layered clad composite material, four motors out of 10 motors stopped. This means that the addition of Cu to the AuAg alloy of the surface layer followed by the further addition of Pd is important, and the addition of only Pd without the addition of Cu is not expected to produce sufficient effects.

TABLE 1

(Temperature: 70° C. Time; 96 hours)

| | Numerals in Composition is % in weight | Hardness (Hv) | Number of Conduction | Abrasion Powder, Black Powder | Abrasion Area ($\mu m^2$) | Abrasion Depth ($\mu m$) | Needle-loke Abrasion Powder | Starting Voltage Change (V) |
|---|---|---|---|---|---|---|---|---|
| Ex. 1 | AuAg35Cu5/ AgPd1Cu4N10.5 CuSn2.3Ni9.5 | 108 | 0 | ○~Δ | ◎ | ○ | ◎ | ◎ |
| Ex. 2 | AuAg37Cu3/ AgPd1.5Cu4Ni0.5/ CuSn2.3Ni9. 5 | 110 | 0 | ○ | Δ | ○ | ○ | ◎ |
| Ex. 3 | Au(diffused material)/ AgCu10Ni0.5/ CuSn2.3Ni9.5 | 111 | 0 | ○ | ◎ | ◎ | ◎ | ◎ |
| Ex. 4 | AgCu6Ni0.5/ CuSn2.3N19.5 | 115 | 0 | ○ | Δ | ○ | ○ | ◎ |
| Ex. 5 | AgCu8Ni0.5/ CuSn2.3N19.5. | 113 | 0 | ○~Δ | ◎ | ◎ | ◎ | ◎ |
| Ex. 6 | AgCu10Ni0.5/ CuSn2.3Ni9.5 | 115 | 0 | ○ | ◎ | ◎ | ◎ | ◎ |
| Ex. 7 | AgPd0.5Cu4Ni0.5/ CuSn2.3Ni9.5 | 109 | 0 | ○ | ◎ | ◎ | ◎ | ◎ |
| Ex. 8 | AgPd1CulNi0.5/ CuSn2.3Ni9.5 | 101 | 0 | ○ | ◎ | ◎ | ◎ | ◎ |
| Ex. 9 | AgPd1.5Cu4Ni0.5/ CuSn2.3Ni9.5 | 101 | 0 | ○ | ◎ | ◎ | ○ | ○ |

TABLE 2

(Temperature: 70° C. Time; 96 hours)

| | Numerals in Composition is % in weight | Hardness (Hv) | Number of Conduction | Abrasion Powder, Black Powder | Abrasion Area ($\mu m^2$) | Abrasion Depth ($\mu m$) | Needle-loke Abrasion Powder | Starting Voltage Change (V) |
|---|---|---|---|---|---|---|---|---|
| Pri. Ex. 1 | AuAg40/ AgCu4Ni0.5/ CuSn2.3Ni9.5 | 110 | 0 | Δ | X | X | X | ◎ |
| Comp Ex. 1 | AgCu4Ni0.5/ CuSn2.3Ni9.5 | 113 | 4 | Δ | X | X | X | Δ |
| Comp Ex. 2 | AgPd3Cu4Ni0.5/ CuSn2.3Ni9.5 | 104 | 10 | Δ~X | Δ | ○ | Δ~X | X |

TABLE 3

(Temperature 70° C., Time; 500 hours)

| | Numerals in Composition is % in weight | Hardness (Hv) | Number of Conduction | Abrasion Powder, Black Powder | Abrasion Area ($\mu m^2$) | Abrasion Depth ($\mu m$) | Needle-loke Abrasion Powder | Starting Voltage Change (V) |
|---|---|---|---|---|---|---|---|---|
| Ex. 10 | Au(diffused material)/ AgCu10Ni0.5/ CuSn2.3Ni9.5 | 111 | 0 | Δ | Δ | ○ | ○ | ◎ |
| Ex. 11 | AuAg35Cu5/ AgPd1Cu4Ni0.5/ CuSn2.3Ni9.5 | 108 | 0 | Δ | Δ | ○ | ○ | ◎ |
| Pri. Ex.2 | AuAg40/ AgCu4Ni0.5/ CuSn2.3Ni9.5 | 110 | 10 | X | X | X | X | X |

TABLE 4

(Temperature: −30° C., Time: 500 hours)

| | Numerals in Composition is % in weight | Hardness (Hv) | Number of Conduction | Abrasion Powder, Black Powder | Abrasion Area ($\mu m^2$) | Abrasion Depth ($\mu m$) | Needle-loke Abrasion Powder | Starting Voltage Change (V) |
|---|---|---|---|---|---|---|---|---|
| Ex. 12 | Au(diffused material)/ AgCu10Ni0.5/ CuSn2.3Ni9.5 | 111 | 0 | ○ | ◎ | ◎ | ◎ | ○ |
| Ex. 13 | AuAg35Cu5/ AgPd1Cu4Ni0.5/ CuSn2.3Ni9.5 | 108 | 0 | ○ | ◎ | ◎ | ◎ | ○ |
| Pri. Ex.3 | AuAg40/ AgCu4Ni0.5/ CuSn2.3Ni9.5 | 110 | 3 | X | X | X | X | X |

TABLE 5

(Temperature: 70° C. Time; 192 hours)

| | Numerals in Composition is % in weight | Hardness (Hv) | Number of Conduction | Abrasion Powder, Black Powder | Abrasion Area ($\mu m^2$) | Abrasion Depth ($\mu m$) | Needle-loke Abrasion Powder | Starting Voltage Change (V) |
|---|---|---|---|---|---|---|---|---|
| Ex. 14 | AuAg37Pd0.5Cu3/ AgPd0.5Cu4Ni0.5/ CuSn2.3Ni9.5 | 108 | 0 | ○~Δ | Δ | ◎ | ○ | ◎ |
| Ex. 15 | AuAg37Pd5Cu3/ AgPd0.5Cu4Ni0.5/ CuSn2.3Ni9.5 | 106 | 0 | Δ | Δ | ○ | Δ | ◎ |
| Ex. 16 | AuAg35Pd0.5Cu5/ AgPd0.5Cu4Ni0.5/ CuSn2.3Ni9.5 | 117 | 0 | ○ | ○ | ◎ | ◎ | ◎ |
| Ex. 17 | AuAg35Pd5Cu5/ AgPd0.5Cu4Ni0.5/ CuSn2.3Ni9.5 | 106 | 0 | ○ | Δ | ◎ | ◎ | ◎ |
| Ex. 18 | Pt5AuAg35Cu5/ AgPd1Cu4Ni0.5/ CuSn2.3Ni9.5 | 160 | 0 | ○ | Δ | ◎ | ◎ | ◎ |
| Ex. 19 | Pt0.5AgCu4Ni0.5/ CuSn2.3Ni9.5 | 141 | 0 | ○ | ◎ | ◎ | ◎ | ◎ |
| Comp Ex. 4 | AuAg35Cu5/ AgPd0.5Cu4Ni0.5/ CuSn2.3Ni9.5 | 108 | 0 | ○~Δ | Δ | ○ | ○ | ◎ |
| Comp Ex. 5 | AuAg40Pd5/ AgPd0.5Cu4Ni0.5/ CuSn2.3Ni9.5 | 96 | 4 | Δ~X | X | Δ | X | ◎ |

We claim:

1. A sliding contact comprising an alloy comprising 0.1 to 1.5 wt. % palladium, 3 to 10 wt. % copper and the balance being silver and further comprising 0.1 to 1 wt. % nickel.

2. The sliding contact of claim 1 comprising a two-layered composite, said composite comprising a surface layer comprised of said alloy and a base layer comprised of copper or a copper-containing alloy.

3. A three-layered composite comprising:

(1) a surface layer comprised of an alloy selected from the group consisting of:

(i) 10 to 60 wt. % silver, 0.1 to 7 wt. % copper and the balance being gold:

(ii) 10 to 60 wt. % silver, 0.1 to 7 wt. % palladium, 0.1 to 7 wt. % copper and the balance being gold; and (iii) 10 to 60 wt. % silver, 0.1 to 7 wt. % platinum, 0.1 to 7 wt. % copper and the balance being gold;

(2) an intermediate layer comprised of an alloy selected from the group consisting of:

(i) 0.1 to 1.5 wt. % palladium, 3 to 10 wt. % copper and the balance being silver;

(ii) 0.1 to 1.5 wt. % platinum, 3 to 10 wt. % copper and the balance being silver;

(iii) 0.1 to 1.5 wt. % palladium, 3 to 10 wt. % copper, 0.1 to 1 wt. % nickel and the balance being silver;

(iv) 0.1 to 1.5 wt. % platinum, 3 to 10 wt. % copper, 0.1 to 1 wt. % nickel and the balance being silver; and (v) 5 to 10 wt. % copper, 0.1 to 1 wt. % nickel and the balance being silver; and (3) a base layer comprised of copper or a copper containing alloy.

4. The three-layered composite of claim 3 wherein:

(1) the surface layer comprises alloy (i); and (2) the intermediate layer comprises alloy (i) or (ii).

5. The three-layered composite of claim 3 wherein:

(1) the surface layer comprises alloy (i); and (2) the intermediate layer comprises alloy (iii).

6. The three-layered composite of claim 3 wherein:

(1) the surface layer comprises alloy (i); and (2) the intermediate layer comprises alloy (iv).

7. The three-layered composite of claim 3 wherein:

(1) the surface layer comprises alloy (i); and (2) the intermediate layer comprises alloy (v).

8. The three-layered composite of claim 3 wherein:

(1) the surface layer comprises alloy (i); and (2) the intermediate layer comprises alloy (i) or (ii).

9. The three-layered composite of claim 3 wherein:

(1) the surface layer comprises alloy (ii); and (2) the intermediate layer comprises alloy (iii).

10. The three-layered composite of claim 3 wherein:

(1) the surface layer comprises alloy (ii); and (2) the intermediate layer comprises alloy (iv).

11. The three-layered composite of claim 3 wherein:

(1) the surface layer comprises alloy (ii); and (2) the intermediate layer comprises alloy (v).

12. The three-layered composite of claim 3 wherein:

(1) the surface layer comprises alloy (iii); and (2) the intermediate layer comprises alloy (i) or (ii).

13. The three-layered composite of claim 3 wherein:

(1) the surface layer comprises alloy (iii); and (2) the intermediate layer comprises alloy (iii).

14. The three-layered composite of claim 3 wherein:

(1) the surface layer comprises alloy (iii); and (2) the intermediate layer comprises alloy (iv).

15. The three-layered composite of claim 3 wherein:

(1) the surface layer comprises alloy (iii); and (2) the intermediate layer comprises alloy (v).

16. A direct current motor comprising a commutator comprising the three-layered composite of claim 5.

17. A direct current motor comprising a commutator comprising the three-layered composite of claim 9.

* * * * *

UNITED STATES PATENT AND TRADEMARK OFFICE

CERTIFICATE OF CORRECTION

PATENT NO. : 5,876,862 
DATED : March 2, 1999
INVENTOR(S) : Isao Shibuya, Toshiya Yamamoto, Takao Asada and Tetsuya Nakamura It is certified that error appears in the above-identified patent and that said Letters Patent is hereby corrected as shown below:

Title page,
Title, correct "COMPOOSITE" to read -- COMPOSITE --

Column 5,
Line 15, correct "width" to read -- weight --

Column 15,
Line 6, correct "alloy (i);" to read -- alloy (ii) --

Signed and Sealed this

Twelfth Day of November, 2002

*Attest:*

*Attesting Officer*

JAMES E. ROGAN
*Director of the United States Patent and Trademark Office*